United States Patent [19]

Heymann et al.

[11] 3,959,564

[45] May 25, 1976

[54] METHOD FOR THE PRELIMINARY TREATMENT OF PLASTIC SURFACES FOR ELECTROPLATING

[75] Inventors: Kurt Heymann; Gunter Woldt, both of Berlin, Germany

[73] Assignee: Schering Aktiengesellschaft, Berlin and Bergkamen, Germany

[22] Filed: Feb. 6, 1974

[21] Appl. No.: 440,192

Related U.S. Application Data

[63] Continuation-in-part of Ser. No. 273,031, July 19, 1972, abandoned, which is a continuation of Ser. No. 63,900, Aug. 14, 1970, abandoned.

[30] Foreign Application Priority Data

Sept. 25, 1969 Germany ..... 1949278

[52] U.S. Cl. ..... 427/430; 204/30; 204/38 E; 427/306

[51] Int. Cl.[2] ..... B05D 1/18; B05D 3/10

[58] Field of Search ..... 427/430, 306; 204/30, 204/38 E

[56] References Cited

UNITED STATES PATENTS

| | | | |
|---|---|---|---|
| 3,437,507 | 4/1969 | Jensen | 117/160 R |
| 3,507,681 | 4/1971 | Cooper | 117/160 R |

*Primary Examiner*—Harry J. Gwinnell
*Attorney, Agent, or Firm*—Joseph F. Padlon

[57] ABSTRACT

In the pickling and activation of plastic surfaces with a chromo-sulfuric acid bath containing a noble metal chloride, the bath is boiled prior to use for a period of time sufficient to eliminate substantially all free chlorine present. Thereafter the plastic surface is pickled and activated in the bath, and then chemical metal plated.

4 Claims, No Drawings

METHOD FOR THE PRELIMINARY TREATMENT OF PLASTIC SURFACES FOR ELECTROPLATING

CROSS-REFERENCE TO RELATED APPLICATION

This application is a continuation-in-part of application Ser. No. 273,031, filed July 19, 1972, which in turn is a continuation of Ser. No. 63,900, filed Aug. 14, 1970, both now abandoned.

BACKGROUND OF THE INVENTION

The invention relates to the preliminary treatment of plastic surfaces in order to prepare them for the application of chemical metal platings thereon. As is known, plastics cannot be readily metallized, and various methods are necessary for preliminary preparatory treatment of the plastic surfaces. The most commonly used pretreatment is that of pickling and activation, precedent to subsequent chemical and galvanic metallization. The pickling and activation are customarily effected either separately or in a single reaction stage.

Thus, for example, German Pat. No. 1,264,921 describes a method for the preliminary treatment of acrylonitrile-butadiene-styrene(ABS) copolymers, wherein the surface is treated in a single reaction stage with a solution of concentrated sulfuric acid containing an oxidant, such as chromic acid, and a noble metal salt. In one example of the patent, a value of 6% by weight of chromic acid is disclosed as a practical figure.

French Pat. No. 1,493,783 describes a similar method wherein a 5.4 to 18.45 molar sulfuric acid solution containing gold, silver, or palladium ions is used, to which up to 0.45 mole/liter chromic acid is added.

After pickling and activation, the plastic surfaces are rinsed with water, and then directly chemical metal plated, as for example with nickel, and then galvanized.

In the performance of the pickling-activation operation, it is customary to secure the plastic parts to be treated on racks. These racks are usually metal, e.g. steel, frames covered with insulation to protect them from the corrosive action of the pickling-activation bath. The insulation is usually natural or synthetic rubber.

While the salt of the noble metal, for example palladium, platinum, gold or silver, employed in the pickling-activating solution, may be any suitable soluble salt, such as sulfates, nitrates, acetate, or chlorides, the chlorides are preferred. These are usually added in quantities of about 0.01 to 1 gram of metal salt per 1 liter of chromo-sulfuric acid.

Experience has shown that where pickling-activating baths containing the noble metal in the form of chloride are employed, chlorine is liberated under the strongly oxidizing conditions present. This chlorine strongly attacks the rack insulation, degrading and oxidizing the organic materials therein, causing contamination of the pickling bath, and exposing the metal rack portions to attack by both the bath and the chlorine.

SUMMARY OF THE INVENTION

In accordance with the present invention there is provided a novel method whereby the exposure of the insulated rack to chlorine arising from the pickling-activating bath is eliminated. As a result, attack on the rack insulation is avoided, and it is made possible to retain the plastic parts in the same rack for both the pickling-activation step and the subsequent chemical metal plating step, with no need to transfer the plastic parts to another rack, as has been the case heretofore. In this way, loss of plating metal by coating of exposed rack parts is also eliminated. The insulation itself remains unattacked and is free of deposited metal in the subsequent metallization operation. The complexities of part transfer from rack to rack are avoided.

In accordance with the invention, there is first provided an aqueous pickling-activating bath containing from about 20 to about 40 weight per cent of sulfuric acid, from about 15 to about 30 weight percent of chromic acid, and from about 0.001 to about 1 weight per cent of a noble metal ion in the form of a soluble chloride salt of the noble metal, the balance being water.

It has been found, in accordance with the invention, that free chlorine present can be substantially eliminated from this bath by boiling the bath for a period of time sufficient to effect removal of substantially all the free chlorine present by vaporization thereof.

The time period of boiling the pickling-activating bath will depend upon the concentration of the chloride salt, and the rapidity of evolution of the chlorine, and may thus vary widely, but in general between about ½ and 2 hours boiling is sufficient to eliminate the chlorine.

After the chlorine-elimination step, the plastic parts are subjected to pickling and activation with the pretreated bath in accordance with conventional procedures. Thus, the parts may be placed on the racks and then dipped into the bath. The pickling-activation is advantageously performed at temperature above about 20°C., preferably between about 60° and about 80°C. The residence time of the plastic parts in the bath is about 5 to 10 minutes or more, depending upon the nature of the plastic and the temperature. In some cases the plastic may be first treated with an organic solvent to facilitate the pickling.

After the treatment, the plastic parts are rinsed with water and then the parts, still on the rack, without transferring them as previously required, are immersed in a conventional chemical metal plating bath, such as a nickel or copper bath.

The noble metal ions diffusing into the surface of the activated plastic are reduced to metal nuclei which become firmly anchored in the plastic. After this treatment the parts can be chemically metallized in the usual manner, as illustrated in the accompanying examples, and provided galvanically with any desired additional metal coatings.

Suitable chemical metal reducing/plating baths are, for example, copper and nickel baths which contain formaldehyde or alkali hypophosphite or boranate, or other reducing agents.

The plating process of the invention is applicable to the surface of a wide variety of organic plastic materials, such as, for example, acrylonitrile-butadiene-styrene polymers (ABS polymers), polyolefins such as polyethylene or modified polypropylenes, ester polymers, such as polyethylene terephthalates, polyacrylates and methacrylates, and polyamides, such as nylon. It is of particular value in plating of ABS polymers and modified polypropylene.

The surface of the plastic parts is hardly roughened when the method of the invention is used, which is highly advantageous. Consequently, only very thin coats of deposited metal are required to obtain a good brightness effect. The adhesion of the metal coats is surprisingly improved.

In the Jensen U.S. Pat. No. 3,437,507, there is disclosed a two-stage pickling and activating sequence for the treatment of a plastic (ABS polymer) surface, involving first contacting the plastic with an aqueous chromic acid etching or pickling solution at room temperature followed by water rinsing. In a second stage, the plastic part is immersed in a sulfuric acid activating solution containing a chloride of a noble metal, e.g. palladium chloride, maintained at an elevated temperature, not exceeding about 95°C. However, this temperature is well below the boiling point of the solution, so that under these conditions, no liberation of free chlorine occurs. This is so because, not only is the boiling point of the various liquid components of the solution, namely water (with dissolved solutes), sulfuric acid, and HCl (formed from the noble metal chloride and sulfuric acid), substantially above 100°C., but there is lacking in the Jensen activating solution the oxidizing agent, namely chromic acid, which is required for liberation of chlorine to take place. Hence there is no problem of free chlorine elimination in the Jensen process and no teaching of how to eliminate it. The pickling-activating bath of the present invention contains chromic acid as well as sulfuric acid and the noble metal chloride, enabling the chloric acid, on boiling the solution, to oxidize the chloride ion to free chlorine, which is removed upon boiling the solution.

DESCRIPTION OF THE PREFERRED EMBODIMENTS

The following examples serve to illustrate the practice of the invention, but are not to be regarded as limiting:

EXAMPLE 1

A pickling and activating solution was prepared having the following composition:

25% by weight sulfuric acid
25% by weight chromic acid
0.05% by weight palladium chloride
Balance water The bath is boiled for one hour or until substantially free from chlorine.

Thereafter plastic parts of ABS polymers or modified polypropylene are placed on insulated racks and pickled and activated by immersing in the chlorine-free bath, at 65°C, for 10 minutes.

Subsequently, the parts are rinsed with water, after which they are placed, without transferring them, into a chemical nickel bath of the following composition:

30 gm/l nickel sulfate 10 gm/l sodium hypophosphite
50 bm/l citric acid

With a pH-value of 5 and a temperature of 60° to 70°C. the parts are nickel-plated without the rack insulations being covered with deposited metal.

EXAMPLE 2

The pickle-activation of plastic parts on the basis of ABS polymers or modified polypropylene is effected in a boiled, chlorine-free solution containing 25% by weight of sulfuric acid
25% by weight of chromic acid
0.05% by weight of gold-III-chloride.

The temperature of the solution is 65°C, and the duration of the treatment is about 10 minutes.

The parts are then rinsed with water and placed with the racks in a preliminary reducing bath with 1 gm/l of hydrazine hydrate having a pH-value of 13.

Subsequently, the parts are again rinsed with water and then are copper-plated in a chemical copper bath having the following composition:

10 gm/l $CuSO4 . 5 H_2O$
16 gm/l potassium sodium tartrate
16 gm/l sodium hydroxide
8 gm/l paraformaldehyde
0.005 gm/l rhodanine.

Only the plastic parts are copper-plated, but not the rack insulations.

What is claimed is:

1. Process for the selective pickling and activation of the surface of an organic plastic material comprising the steps of:

a. providing an aqueous pickling and activating bath containing from about 20 to about 40 weight per cent of sulfuric acid, from about 15 to about 30 weight per cent of chromic acid, and from about 0.001 to about 1 weight per cent of a noble metal ion in the form of a soluble chloride salt, balance water;
b. boiling said bath for a period of time sufficient to effect removal of substantially all free chlorine present;
c. contacting said plastic surface with said substantially chlorine-free bath to effect pickling and activation thereof.

2. The process of claim 1 in which the plastic material is an acrylonitrile-butadiene-styrene polymer.

3. The process of claim 1 in which the plastic material is a modified polypropylene.

4. The process of claim 1 in which the noble metal is selected from the group consisting of platinum, palladium, gold and silver.

* * * * *